United States Patent [19]

Hinterman et al.

[11] Patent Number: 5,009,091

[45] Date of Patent: Apr. 23, 1991

[54] PRESS COUNTERBALANCE SYSTEM

[76] Inventors: William H. Hinterman, G-5034 Fenton Rd., Flint, Mich. 48057; Timothy W. Hinterman, 2104 Cadillac St., Flint, Mich. 48504

[21] Appl. No.: 577,886.

[22] Filed: Sep. 5, 1990

Related U.S. Application Data

[63] Continuation-in-part of Ser. No. 331,242, Mar. 31, 1989, Pat. No. 4,969,344.

[51] Int. Cl.[5] ..... B21D 24/02

[52] U.S. Cl. ..... 72/21; 72/436; 72/443; 72/438; 72/19; 100/259

[58] Field of Search ..... 72/21, 445, 450, 436, 72/453.13, 443, 438; 100/259, 231

[56] References Cited

U.S. PATENT DOCUMENTS

| | | | |
|---|---|---|---|
| 2,084,066 | 6/1937 | Rode et al. | 72/450 |
| 2,767,601 | 10/1956 | Reed | 72/445 |
| 2,857,157 | 10/1958 | Bonquet | 100/259 |
| 2,970,327 | 2/1961 | Friedman | 72/450 |
| 3,557,600 | 1/1971 | Saito | 72/450 |
| 3,834,216 | 9/1974 | Schiller et al. | 72/450 |
| 4,011,809 | 3/1977 | Waller et al. | 100/259 |
| 4,069,697 | 1/1978 | Morrison et al. | 72/445 |
| 4,283,929 | 8/1981 | Heiberger | 72/445 |
| 4,308,735 | 1/1982 | Nishi | 100/259 |
| 4,692,857 | 9/1987 | Chi | 72/21 |

*Primary Examiner*—David Jones

*Attorney, Agent, or Firm*—Gifford, Groh, Sprinkle, Patmore and Anderson

[57] ABSTRACT

A control system for automatic counterbalancing the ram of a mechanical press by measuring energy level of the press flywheel and varying air pressure in a counterbalancing cylinder. Energy level is derived from a measurement of the linear speed of a moving press component at a fixed point in the ram reciprocation cycle.

7 Claims, 1 Drawing Sheet

PRESS COUNTERBALANCE SYSTEM

Related Application

This is a continuation-in-part of application Ser. No. 331,242 filed Mar. 31, 1989 now U.S. Pat. No. 4,969,344.

BACKGROUND OF THE INVENTION

1. Field of the Invention

This invention relates to a control system for mechanical presses, and, more particularly, to an automatic control system for adjusting the counterbalance for such a press.

2. Description of the Prior Art

Mechanical presses are commonly used for stamping, bending, blanking, embossing and otherwise shaping materials, usually metals. Replaceable die sets are used to do such forming with a lower die half attached to a stationery bed or platen and an upper die half attached to a ram or slide which reciprocates vertically. Typically in a mechanical press, an electric motor is used to rotate a counterweight or flywheel, bringing the rotational speed of the counterweight up to a no-load equilibrium speed which will provide the proper kinetic energy to perform the forming operation. A clutch mechanism engages the flywheel which, through gears and mechanical linkage, reciprocates the ram in its working cycle using the inertia of the flywheel. Counterbalances are used to counterbalance the moving weight of the ram and its attached upper die half or punch to provide smooth operation, easier stopping, and less wear on the gears, bearings and other moving parts of the press.

Mechanical presses commonly use one or more pneumatic cylinders to perform the counterbalancing function. Typically, the air pressure is adjusted by the press operator through a manual pressure regulator when a new set of dies are put into the press to compensate for the change in the weight of the die. Usually, very little further adjustments are made of the air pressure, unless they are made pursuant to the "feel" that an experienced operator has in the efficient running of the press.

Systems have been developed for automatically adjusting the air pressure in an attempt to compensate for various effects. For example, in U.S. Pat. No. 4,283,929, the die sets, or at least the upper die or punch member is encoded so that when a new die set is put into the machine, this coding is read by the machine to automatically make an adjustment in the counterbalance air pressure to compensate for the change in the weight of the die. Other attempts have been made to automatically compensate for change in the die weight and the speed of the press by measurement of the motor current only. U.S. Pat. No. 4,069,697 teaches changing the air pressure responsive to a current signal so that adjustment for excess counterbalancing is accomplished on a down stroke and compensation for insufficient counterbalancing is done on an upstroke. Unfortunately, adjustments for die weight or motor current only solves part of the problem.

SUMMARY OF THE INVENTION

The present invention is directed to automatically adjusting the counterbalancing force provided by air pressure in compensating cylinders from a measurement of energy level of the press flywheel at a fixed point or points during reciprocation of the ram. This improvement and its advantages are seen in a system in which the press is operated by an electric motor and utilizes a flywheel to impart energy to reciprocate the ram. Single or multiple air operated cylinders are used to counterbalance the downward working force of the ram.

The energy changes of the press's main rolling member, the flywheel, can be indicated by the only variable of that particular member, namely its angular velocity. The flywheel's energy is translated to the ram in the form of linear motion by interconnected mechanical drive components. The related speed of the flywheel will impart a proportional speed to the ram. The energy lost in conduction by the mechanical components from the flywheel to the ram, due to friction, flex, force of gravitational acceleration etc., will be constant and can be compensated in the system controller since the controller will be programmmed to operate on speed differential.

An underbalanced condition implies a hanging weight situation. This means that the unchecked weight will fall from the top to the bottom of the stroke and will act as a potential energy source. This falling weight will impart an angular velocity increase to the flywheel. The unchecked weight will have to be lifted from the bottom to the top of the stroke. This implies that the flywheel energy must be expended to lift this unchecked weight from the bottom to the top of the press stroke. Speed being the only variable of this energy source as energy is expended, the flywheel's angular velocity will slow to reflect this energy loss. Since energy is translated proportionately through the mechanical components, the speed change will be reflected in all components along the conduction line. This in turn infers that any speed changes along the energy conduction route will indicate the energy expenditure of the flywheel.

An overbalanced condition implies an opposing force being greater than the hanging weight of the press parts. This means that the flywheel will have to expend energy to push the ram from the top to the bottom of the stroke. This expenditure will cause the flywheel's angular velocity to decrease. The greater opposing force will lift the ram from the bottom to the top of the stroke. This action will restore energy to the flywheel and the angular velocity will increase.

A sensor detects a condition which is indicative of the energy level of the flywheel. In our prior application, Ser. No. 331,242, the angular velocity of the flywheel was detected to give an indication of this energy level. Also the power supplied to the flywheel motor was alternatively used to detect this energy level. In the present application, the sensor detects the speed of the ram, and the control system is responsive to the sensor for increasing or decreasing the air pressure in the air cylinder when this pressure is under or over balancing the ram. The speed of the ram can be measured during the downstroke and the upstroke to initiate the control function.

As indicated above, the ram speed can be measured by detecting the speed of one of the drive components interconnecting the flywheel with the ram, including, for example, the speed of the counterbalancing cylinder piston rod. Since the speed is measured at a fixed point, the acceleration or deceleration or change in momentum is monitored by the control system. Preferably, the speed is detected by a proximity switch directed to a target mounted on a component of the press drive mechanism. The speed is "calculated" by the control system microprocessor from the time required for the target to traverse the sensor beginning at the leading edge and ending at the trailing edge of the target.

In one of the preferred embodiments of the invention, a detector or sensor is used to measure the rotational speed of the flywheel and two additional sensors are used to detect ram speed, one sensor detecting speed during the ram upstroke and the other sensor detecting speed during the ram downstroke.

The flywheel speed is used to detect when the flywheel has been brought up to working speed upon start-up or when the flywheel has regained its equilibrium speed after a working cycle has been completed. The flywheel speed also detects a change of speed initiated in a multi-speed press when the change is made, while the press is idling.

The upstroke speed is obtained from a target which is mounted to pass by its sensor within 180°-360° of the press stroke cycle. Likewise, the downstroke speed is obtained from a target which is mounted to pass by its sensor within 0°-180°. If the relationship between the upstroke speed and the downstroke speed varies from their predetermined values, the control will cause the pressure in the air cylinder to be changed to correct the out-of balanced condition.

The pressure in the counterbalance cylinder or cylinders can also be measured and used in a feedback control loop to determine when the pressure settles to the new value which the speed control indicated was necessary to correct an underbalanced or overbalanced condition. This allows the control to delay an appropriate length of time between a pressure adjustment made in a counterbalancing system of any volume size to avoid a hunting condition. Once the pressure has settled, the controller will monitor the counterbalance condition and initiate new control signals using the two ram speed sensors.

Increases in pressure to one or more counterbalancing cylinders being used are effected by the use of a modulating valve to increase the air supply pressure to the cylinder. Decreases in cylinder pressure are effected by using a solenoid-operated valve which vents the excess pressure to atmosphere.

The foregoing advantages and others will become more apparent from the following description and the accompanying drawing.

DETAILED DESCRIPTION OF THE PREFERRED EMBODIMENTS OF THE INVENTION

Figure 1:
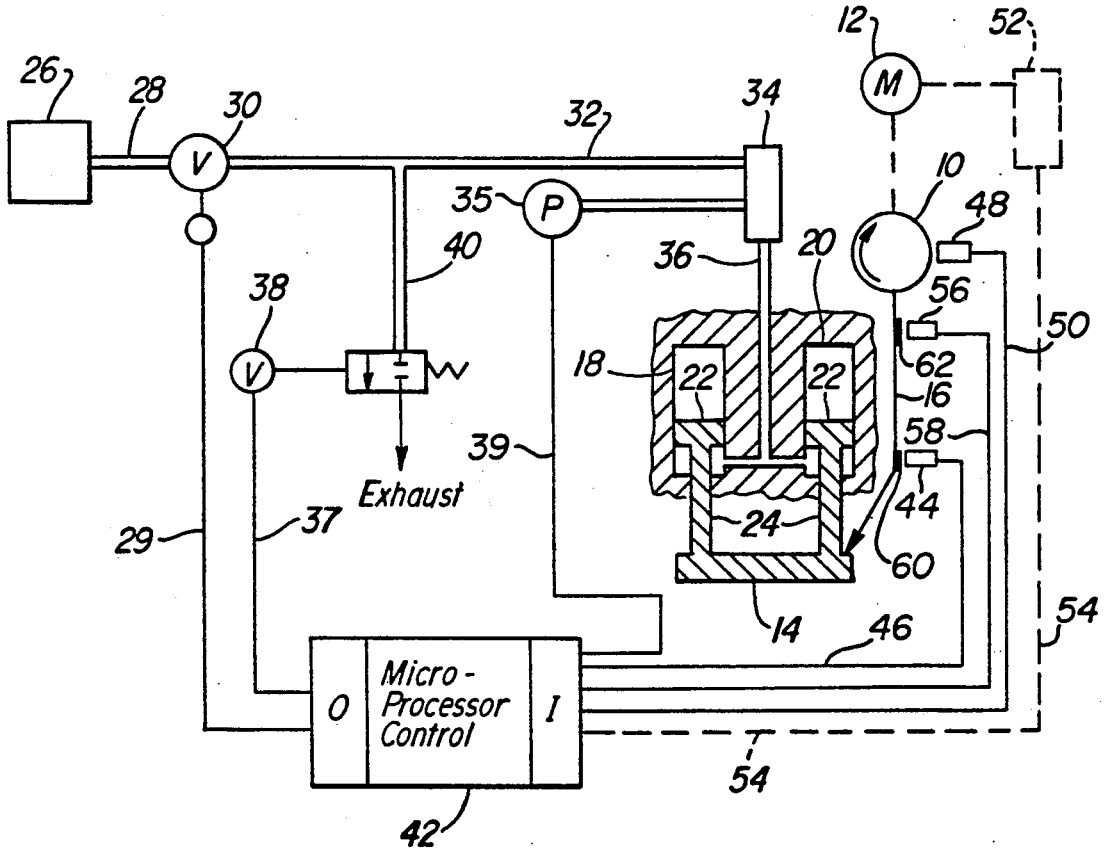
FIG. 1 is a schematic view of the control system of this invention which detects the energy level of the press flywheel at a fixed point or points in the working stroke of the ram to make adjustments in the air pressure value in the counterbalance compensating cylinders attached to the ram.

FIG. 1 shows the control system of this invention as it is applied to the essential portions of a typical press. The press has a flywheel 10 which is driven by an electric motor 12. The flywheel, in turn, drives the press ram 14 by drive components including various mechanical linkages including a clutch, gears and the like schematically shown by connection 16. The downward force of the ram in its working cycle is counterbalanced by compensating counterbalance cylinders 18 and 20 which are connected to the ram 14 through pistons 22 and piston rods 24. Compressed air is supplied to the cylinders 18 and 20 from a source 26 through air line 28, modulating valve 30, air line 32, surge tank 34 and air line 36. Air is exhausted from the cylidners 18 and 20 by solenoid-operated exhaust valve 38 through air line 36 and surge tank 34, and air lines 32 and 40. It will be appreciated that other equivalent valve arrangements can be utilized with one or more equivalent counterbalancing air cylinders.

Microprocessor control 42 receives control signals at input I and outputs control signal at output O.

The rotational speed of flywheel 10 is measured by detector 48. Speed detector 48 can be any device that creates an analog, digital or electromagnetic wave signal proportional to speed. This signal from detector 48 is transmitted to the input I of the microprocessor 42 by line 50.

The stroking speed of the press with the flywheel engaged is measured using sensors 44 and 56. These two sensors can be any suitable device as mentioned for detector 48. A preferred method of speed detection is by the use of a ferrous target 60 passing proximity switch 44 and by the use of a ferrous target 62 passing proximity switch 56. Upstroke target 60 is mounted on the drive mechanism of the press shown in FIG. 1 as connection 16, and the target 60 is mounted so it will pass proximity sensor 44 between 180°-360° of the forward press stroke cycle. The signal from sensor 44 is transmitted to the input I of microprocessor 42 by the line 46. The duration of the signal is an indication of speed, and it is the time required for the target 60 to traverse the sensor 44 beginning at the leading edge and ending at the trailing edge of the target. Downstroke target 60 is mounted on the drive mechanism of the press shown in FIG. 1 as connection 16, and the target 62 is mounted so it will pass proximity sensor 56 between 0°-180° of the forward press stroke cycle. The signal from sensor 56 is transmitted to the input I of microprocessor 42 by the line 58. The duration of the signal is an indication of speed, and it is the time required for the target 62 to traverse the sensor 56 beginning at the leading edge and ending at the trailing edge of the target.

Pressure transducer 35 measures the pressure in the counterbalancing cylinders 18 and 20 through air line 36 and surge tank 34. This pressure is transmitted to the microprocessor input I by line 39.

Microprocessor 42 outputs control signals from its output O through line 29 to modulating valve 30 to increase the pressure in counterbalancing cylinders 18 and 20, and it outputs a signal through line 37 to solenoid valve 38 to decrease pressure in counterbalancing cylinder 18 and 20 by exhausting air to the atmosphere.

With the foregoing instrumentation in place, the relationships between the flywheel speed, ram upstroke speed and ram downstroke speed at balanced condition can be determined to provide optimum control for a single speed press or a variable speed press. These curve characteristics can be stored in the memory of the microprocessor 42 in the form of: (1) ram upstroke speed versus flywheel speed, (2) ram downstroke speed versus flywheel speed and (3) ram upstroke speed versus ram downstroke speed. These relationships allow the microprocessor to determine the ideal values required for a balanced condition. If a stroke speed change takes place while the press is idling, the microprocessor will use the detector 48 to determine the new speed. From this value, the downstroke speed versus flywheel speed characteristic will yield ideal downstroke speed necessary for a balanced condition at that speed.

Similarily the upstroke target speed versus downstroke target versus pressure changes with respect to stroking speed can be established to allow the processor to generate a pressure response for any speed differential in the upstroke or downstroke for any stroke speed selected. For example, if a variable speed press is underbalanced indicating a need to raise the pressure in the counterbalance cylinders 18 and 20, it will require a greater pressure to balance a faster stroking press than a slower stroking press. This is due to the fact that the downward stroking force is greater for a given die mass moving at a greater velocity, that is, the die has a greater momentum. Microprocessor memory can be programmed with counterbalancing pressure versus upstroke target speed differential versus downstroke target speed differential. With this information, the microprocessor has the ability to generate ideal target speeds for any stroke speed selected. The control then can function to make changes for a speed change made while the press is in motion or while the press is being idled. Once the press is in motion, the microprocessor can compare the actual ram upstroke and ram downstroke speeds to their respective ideal values and make an accurate pressure adjustment to the counterbalance system when a change is needed.

For a single speed press, the microprocesser will not have data for speed changes so that the detector 48 measuring the flywheel speed will supply the microprocessor information for settling purposes only. When the working stroke is complete, the flywheel speeds up until it regains all of its original energy. The microprocessor will determine when this speed settles to its full idling speed through sensor 48. With the speed settled, the microprocessor will check the ram's up/-downstroke speeds on the first stroke of the press's working cycle. The comparison of these actual speeds to their respective ideal values will indicate the press's counterbalanced condition. If this comparison indicates an underbalanced condition, the pressure will be increased using modulating valve 30 through line 29. If the comparison indicates an overbalanced condition, the pressure in air cylinders 18 and 20 will be decreased by actuation of exhaust valve 38 through line 37. If the working stroke begins before the flywheel idle speed has settled to its full idling speed, the microprocessor will not respond to the ram speed readings made on the first stroke. This process allows the control system to respond to an out-of-balance condition on the first stroke.

If a pressure adjustment is required by the ram's upstroke and downstroke speed comparison to their ideal values, the pressure adjustment will be made. The pressure measured by the transducer 35 will indicate when the counterbalance pressure settles to its new value. This allows the microprocessor to delay an appropriate length of time between a pressure adjustment for any volume size of the counterbalance system.

Once the pressure has settled in response to a change made, the microprocessor will continue to monitor the counterbalanced condition using the speed of upstroke target 60 as it passes sensor 44 and the speed of the downstroke target 62 as it passes sensor 56. If these actual speed values indicate an out-of-balanced condition when compared to their respective ideal values, a response will be initiated. If this comparison indicates an underblanced condition, the pressure will be increased using moldualting valve 30 through line 29. if the comparison indicates an overbalanced condition, the pressure in air cylinders 18 and 20 will be decreased by actuation of exhaust valve 38 through line 37.

In a variable speed press, the detector 48 not only is used to indicate the settling of the idling flywheel speed, but it is also used to indicate any new stroke speed changes that are made while the press is idling. If such a speed change is detected, the microProcessor will respond to its stored curve characteristics to generate the values for controlling the counterbalanced condition. The ram upstroke speed and the ram downstroke speed are not only used to detect the counterbalanced condition, but are also used to indicate any new stroke speed changes if the change is made while the press is in motion. Once new speed has been determined using the ram upstroke speed versus the ram downstroke speed, the microprocessor will use a corrsponding new curve characteristic to generate the set point values for controlling the counterbalanced condition.

In another embodiment of the control system, the energy level of the flywheel 10 can be calculated from an instantaneous measure of the power input to the motor 12 as measured by wattmeter 52 which sends a signal to input I of the microprocessor control 42 by line 54. The set point reference power utilized in this mode is taken from a measurement under no-load conditions. With the wattmeter 52 detecting power at a point in the downstroke of the ram 14 and at a point in the upstroke of the ram 14, the comparison of these power levels compared to their ideal values will indicate the counterbalanced condition. If the comparison indicates an counterbalanced condition, the microprocessor would open the valve 30 to increase the pressure being supplied to counterbalance cylinders 18 and 20. Likewise, if the power comparison indicates an overbalanced conditon, the microprocessor 42 would decrease the pressure in the cylinders through the use of the exhaust valve 38.

The embodiments of the invention in which an exclusive property or privilege is claimed are defined as follows:

1. In a press which engages a flywheel to impart energy to reciprocate a ram through interconnected drive components, said press having air-operated cylinder means for automatically counterbalancing the downward working force of said ram, an improved system for adjusting the counterbalancing air pressure in said air cylinder means according to the energy level of the flywheel comprising:

sensor means for detecting the speed of said ram which is indicative of the energy level of said flywheel; and control means for comparing the speed of said ram detected by said sensor means to a predetermined value and increasing or decreasing the air pressure in said air cylinder means according to said comparison to overcome under or over counterbalancing of said ram.

2. The improved system according to claim 1 wherein said sensor detects the speed of said ram by measuring the speed of one of said drive components.

3. The improved system according to claim 2 wherein said sensor means including a first sensor measuring the downstroke speed of the ram and a second sensor measuring the upstroke speed of the ram, said control means comparing these speeds to predetermined values during the first stroke cycle after the flywheel has been engaged, and if the comparison indicates an underbalanced conditon, causing the pressure to be increased in said air cylinder means, and if the comparisons indicates an overbalanced condition, causing the pressure to be decreased in said air cylinder means.

4. The improved system according to claim 3 further including a detector for measuring the rotational speed of said flywheel, said control means comparing the speed of said flywheel with a predetermined speed and enabling a pressure change only if said predetermined speed has been reached.

5. The improved system according to claim 2 wherein said sensor means measures the downstroke speed of the ram along with the upstroke speed of the ram, following the first stroke after said flywheel has been engaged.

6. The improved system according to claim 5 wherein if the downstream speed and the upstroke speed deviate from their respective predetermined values, a counterbalance pressure adjustment will be initiated, with an underbalanced condition causing the control system to raise the pressure in said air cylinder means, and with an overbalanced condition causing the control system to decrease the pressure in said cylinder means.

7. In a press which engages a flywheel to impart energy to reciprocate a ram through directly connected drive components, said press having air-operated cylinder means for automatically counterbalancing the downward working force of said ram, an improved system for adjusting the counterbalancing air pressure in said air cylinder means according to the energy level of the flywheel comprising:

a detector for measuring the rotational speed of said flywheel;

first sensor means for detecting the speed of said ram during an upstroke;

second sensor means for detecting the speed of said ram during a downstroke; and control means comparing the speed of said flywheel with a predetermined flywheel speed, comparing the speed of the ram on the upstroke and downstroke during the first stroke cycle of the press, after said flywheel has been engaged with respective predetermined values to determine the counterbalanced condition causing the control system to increase or decrease the pressure in said air cylinders to correct an out-of-balance condition;

said control means comparing the speed of said flywheel with a predetermined flywheel speed, comparing the speed of the ram on the upstroke and downstroke after the first stroke cycle of the press, after said flywheel has been engaged, with a second set of respective predetermined values to determine the counterbalanced condition, causing the control system to increase or decrease the pressure in said air cylinders to correct an out-of-balance condtion.

* * * * *